US007332118B2

(12) United States Patent
Asmussen

(10) Patent No.: US 7,332,118 B2
(45) Date of Patent: Feb. 19, 2008

(54) METHOD OF PREPARING AND METHOD OF APPLYING A VIBRATION DAMPING SYSTEM

(75) Inventor: John Asmussen, Copenhagen S (DK)

(73) Assignee: Rockwool International A/S (DK)

( * ) Notice: Subject to any disclaimer, the term of this patent is extended or adjusted under 35 U.S.C. 154(b) by 732 days.

(21) Appl. No.: 10/472,994

(22) PCT Filed: Apr. 4, 2002

(86) PCT No.: PCT/DK02/00227

§ 371 (c)(1),
(2), (4) Date: Feb. 23, 2004

(87) PCT Pub. No.: WO02/081820

PCT Pub. Date: Oct. 17, 2002

(65) Prior Publication Data

US 2004/0121096 A1 Jun. 24, 2004

(30) Foreign Application Priority Data

Apr. 4, 2001 (DK) ..... 2001 00556

(51) Int. Cl.

| | |
|---|---|
| ***B29C 43/18*** | (2006.01) |
| ***E01C 5/18*** | (2006.01) |
| ***E01C 3/06*** | (2006.01) |
| ***E01C 11/24*** | (2006.01) |

(52) U.S. Cl. ..... 264/257; 264/320; 404/32; 404/33; 404/72; 404/79; 404/82

(58) Field of Classification Search ..... None
See application file for complete search history.

(56) References Cited

U.S. PATENT DOCUMENTS

| | | | | |
|---|---|---|---|---|
| 3,012,923 | A * | 12/1961 | Slayter | 156/62.2 |
| 3,220,915 | A * | 11/1965 | Shannon | 428/194 |
| 3,238,056 | A | 3/1966 | Pall et al. | |
| 4,210,698 | A * | 7/1980 | Watson | 428/327 |
| 4,362,780 | A * | 12/1982 | Marzocchi et al. | 442/85 |
| 4,720,043 | A * | 1/1988 | Ortwein | 238/2 |
| 5,723,192 | A | 3/1998 | Jonasz | |
| 6,648,547 | B2 * | 11/2003 | Jones et al. | 404/31 |
| 6,858,675 | B1 * | 2/2005 | Taguchi et al. | 525/191 |
| 2003/0086762 | A1 * | 5/2003 | Oka et al. | 404/18 |

FOREIGN PATENT DOCUMENTS

| | | | |
|---|---|---|---|
| DE | 3524519 A1 | | 1/1987 |
| DE | 3527829 A1 | | 2/1987 |
| DE | 4315215 A1 | | 11/1993 |
| EP | 0 922 808 A2 | | 6/1999 |
| WO | WO 93/02259 | * | 2/1993 |
| WO | WO 99/47766 | * | 9/1999 |

OTHER PUBLICATIONS

International Search Report dated Jul. 16, 2002.

* cited by examiner

*Primary Examiner*—Edmund H. Lee
(74) *Attorney, Agent, or Firm*—Dickstein, Shapiro, LLP.

(57) ABSTRACT

The vibration damping system, especially for use in the damping of vibrations e.g. from trains, tramcars, other traffic and damping of ground borne vibrations in general, comprises an anti-vibration plate in the form of a plate having a first and a second major surface. The anti-vibration plate comprises mineral fibers, a non-foamed polymeric material and/or a polymeric foam. The anti-vibration plate can further be provided with one or more hollow spaces, i.e. cavities. The anti-vibration plate is obtainable by a method comprising the step of subjecting an area of the opposite surface of the plate to a compression treatment in one or more steps, which compression treatment is sufficient to reduce the static and/or dynamic stiffness of the plate.

35 Claims, No Drawings

METHOD OF PREPARING AND METHOD OF APPLYING A VIBRATION DAMPING SYSTEM

BACKGROUND OF THE INVENTION

The invention relates to a vibration damping system, especially for use in the damping of vibrations e.g. from trains, tramcars, other traffic and damping of ground borne vibrations in general.

In the prior art, it is well known to incorporate elastic material under traffic lines and in particular under tracks for trains, trolley busses, tramcars and similar traffic lines in order to damp the vibrations caused by this heavy traffic. In the prior art material layers of elastic material especially made from rubber, PUR-foams and cork, respectively, as well as combinations thereof, have been used for damping such vibrations.

One of the preferred materials for the damping of vibrations has so far been plates or mats of vulcanised rubber which has excellent elastic properties for use as vibration damping material. Vibration damping constructions wherein the vibration damping elements are constituted by rubber have in most situations an acceptable vibration damping efficiency, however, the amount of rubber necessary in such constructions in many situations results in a relatively expensive product. Furthermore, there is a general aim to avoid or reduce the use of rubber materials due to environmental pollution during its production and pollution due to escape of additives e.g. softening additives during use in moist environments. U.S. patent publication no. 5,060,856 describes such an elastomeric mat for use e.g. in damping of the sound from trains.

It has also been tried to use a mineral fibre board as sound damping material in railway construction, e.g. as disclosed in DE 35 27 829 and in EP patent publication no. 922 808. This sound damping system has turned out to be very good in certain situations.

In general, it has been found that the use of mineral fibre mats or boards in vibration damping systems for railway foundations is highly desirable due to adequate performance, easy installation, 100% recycling ability, low pollution effect and a competitive price. However with the known mineral fibreboards, there is a risk, when it is used over a long period under high loads, such as the forces from ballast gravels during passage of train, that this may have an effect on the mineral fibre material over time. This aging effect is also seen with some of the known rubber and PUR-materials.

By incorporating the above materials in railway tracks for damping vibration it has been observed that there is a risk that the load from passing trains imposed in the vibration damping system causes an aging of such system over time. Such aging is characterized by the change in static and dynamic stiffness of the anti-vibration plate of the vibration damping system, which is unwanted. For instance, the static and the dynamic stiffness of the anti-vibration plate may decrease and/or increase significantly during the first 5 to 10 years of use.

Normally it is desired that a vibration damping system under railways should have a durability of about 40 years. A minimum demand from Deutsche Bahn-Norm (Technische Lieferbedingungen BN 918 071-1, September 2000) is that through mechanical excitation the static stiffness of the anti-vibration plate of the vibration damping system may not decrease more than about 10-20% during a simulated approximately 40 year-period in the laboratory.

According to standard and practical experience the static and dynamic stiffness should preferably be substantially constant over time.

Accordingly, there remains a need for a vibration damping system of the above-mentioned kind which does not exhibit the above-identified drawbacks.

One object of the invention is therefore to provide a vibration damping system comprising an anti-vibration plate with improved stability with respect to static and particularly dynamic stiffness, and preferably comprising an anti-vibration plate with a substantially constant static and dynamic stiffness during its life time defined as 40 years.

Another object of the invention is to provide a vibration damping system comprising an anti-vibration plate having an upper surface which is sufficiently strong to withstand the replacements of ballast layer which is normally carried out three or four times within the lifetime of the vibration damping system.

These and other objects are achieved by the vibration damping system described below.

DESCRIPTION OF THE INVENTION

The vibration damping system according to the invention has turned out to posses a very high vibration damping effect, whereby undesired vibrations from railway traffic and likewise can be reduced to an acceptable level or even be substantially eliminated. It has been found that the vibration damping effect of the vibration damping system is only slightly or not at all influenced by the temperature of the surrounding environment, which means that the system works effectively under a wide range of temperatures.

Furthermore, the installed vibration damping system according to the invention is competitive with respect to vibration damping systems composed of e.g. rubber alone. Another desired property of the vibration damping system is its durability which is highly increased due to the construction, because materials such as gravel, stone, soil, asphalt, as well as concrete do not result in significant deterioration of the underlying mineral fibre material.

In a first aspect of the invention the vibration damping system comprises an anti-vibration plate in the form of a plate having a first and a second major surface. The anti-vibration plate comprises mineral fibres, a non-foamed polymeric material having a Shore A hardness of between 35-98, and preferably an E-modulus varying between $2\times10^5$ and $69\times10^8$ Pa, preferably between $7\times10^5$ and $35\times10^8$ and/or a polymeric foam with a density of 20-240 kg/m$^3$, and preferably an E-modulus varying between $2\times10^5$ and $69\times10^8$ Pa, preferably between $7\times10^5$ and $35\times10^8$.

In the first aspect of the invention the vibration damping system is especially used in the damping of vibrations e.g. from trains, other traffic and damping of ground borne vibrations in general, wherein ballast gravels are used for the distribution of forces imposed by the load of the trains during their passage.

In a second aspect of the invention the vibration damping system comprises an anti-vibration plate in the form of a plate having a first and a second major surface. The anti-vibration plate comprises mineral fibres and is further provided with one or more hollow spaces, i.e. cavities. The one or more hollow spaces can be obtained by removing a portion of the mineral fibres in the anti-vibration plate. This results in a reduction of the static and/or dynamic stiffness of the plate, and allows the founding on site without risking the leaking of concrete into to the ground. In this second aspect of the invention, the vibration damping system is especially used for the damping of vibrations e.g. from tramcars or the like, where a concrete layer rather than ballast gravels is used for the distribution of forces imposed by the load of the passing tramcar.

Both aspects of the invention are based on the essential issue that the anti-vibration plate is obtainable by a method comprising the step of subjecting an area of the opposite surfaces of the plate to a compression treatment in one or more steps, which compression treatment is sufficient to reduce the static and/or dynamic stiffness of the plate by at least 10%, preferably at least 15%, more preferably at least 20% compared to the static and/or dynamic stiffness prior to the compression. An anti-vibration plate obtainable by this method thus has a substantially constant performance that is a constant static and dynamic stiffness over time.

In a preferred embodiment the anti-vibration plate is obtainable by a method comprising the step of subjecting an area of the opposite surfaces of the plate to a compression treatment, wherein the compression treatment comprises the step of subjecting an area of the opposite surfaces of the plate at the compression pressure in the interval from 50 to 250 kN/m$^2$, preferably from 80 to 200 and more preferably from 100 to 150 kN/m$^2$, whereby the static and/or dynamic stiffness of the plate measured according to the method defined in Deutsche Bahn-Norm BN 918 071-1 (September 2000) is reduced compared to the static and/or dynamic stiffness prior to the compression treatment.

In general it is insignificant which method has been used for subjecting the opposite surfaces of the plate to the compression treatment, however, due to the object to provide a simple and economical method, and thereby an economically acceptable product it is preferred that the anti-vibration plate is obtainable by a method comprising the step of subjecting the plate to a compression treatment by rolling through one or more pairs of rollers. When using this method, the rollers should preferably have a relatively high diameter e.g. a diameter of at least 100 mm in order to make an equal pressure over the whole area of the material.

In a preferred embodiment of the vibration damping system according to the invention the anti-vibration plate is in the form of a layer of polymeric material having a density of 400-1300 kg/m$^3$. The thickness depends largely on the Shore A hardness and density of the polymeric material, as well as the load the anti-vibration plate is supposed to be subjected to. In general a thickness between 5-70 mm is useful.

The polymeric material may comprise natural or synthetic rubbers or mixtures of natural and synthetic rubbers. It is preferred that the polymeric material is made from a material selected from the group consisting of butadiene rubber, butyl rubber, isoprene rubber, styrene-butadiene rubber, natural rubber, polyacrylate rubber, ethylene-acrylate rubber, ethylene-propylene rubber, nitrile rubber and mixtures thereof.

In another embodiment the anti-vibration plate is in the form of a layer of polyurethane foam. The desired thickness and density of the polyurethane foam can easily be found by a skilled person.

In the most preferred embodiment, wherein the ballast gravels are used, the anti-vibration plate is in the form of a layer of mineral fibres having a density of at least 150 kg/m$^3$, preferably between 180 and 550 kg/m$^3$ and more preferably between 200 and 350 kg/m$^3$.

In the alternatively preferred embodiment, wherein concrete is used, the anti-vibration plate is in the form of a layer of mineral fibres comprising hollow spaces and having a density above 200 kg/M$^3$. The density is measured as the ratio of the weight of the anti-vibration plate comprising one or more hollow spaces and the volume of this plate, i.e. length×width×height.

The layer of mineral fibres should preferably comprise at least 20%, preferably at least 50% and more preferably at least 80% by weight of one or more type of mineral fibres e.g. rock, slag, glass and similar vitreous materials.

In general it is preferred that the layer of mineral fibres should have a thickness of between 10 and 100 mm, preferably between 25 and 70 mm. However if the layer of mineral fibres is combined with other layers exhibiting vibration damping effect, the layer of mineral fibres may be thinner.

In order to obtain a very high internal aging resistance in the mineral fibre material it is preferred that at least 75%, preferably at least 85% and more preferably 95% by number of the fibres are placed in a direction substantially parallel +/−25° with the plane of the plate. The plane of the plate is defined as the plane parallel to the first major surface of the anti-vibration plate. The direction of a fibre is determined as the direction of the line representing the longest distance from one point on the fibre to another point on the fibre. Furthermore it is preferred that the major part of the fibres in the vertical direction, perpendicular to the first major surface of the anti-vibration plate +/−22° are broken after the plate has been subjected to the compression treatment.

The anti-vibration plate or at least the exposed surfaces of the plate may be hydrophobic. The surface tension of the fibre material of the plate should preferably not be higher than the surface tension of the natural non-bonded and treated fibres. In some embodiments the plate should preferably be sufficiently hydrophobic to avoid any substantial entrance of water, when water drops at 20° C. are sprayed onto the plate. Particularly it is preferred that the anti-vibration plate has a surface tension below 73 dynes/cm, e.g. having a surface tension below 40 or even below 30 dynes/cm.

Methods of making the mineral fibres hydrophobic are well known in the art.

The anti-vibration plate according to the invention may comprise two or more layers of the same material type, i.e. polymeric material, polymeric foams and mineral fibres wherein the two or more layers may have different or equal densities, different or equal thickness and/or equal or different static stiffness. Furthermore or alternatively, the anti-vibration plate may comprise two or more layers of different material type e.g. combinations of polymeric material layer(s), layer(s) of polymeric foams and layer(s) of mineral fibres. In general any combination of these types of layers is within the scope of the invention.

The system may also comprise two or more anti-vibration plates placed on top of each other where the edge or edges of the plates are placed in distance from each other in order to cover joints. If the plates or the layers of the plates have different densities, the plate or layer with the higher density should preferably be placed upon the plate or layer with the lower density.

During the life time of an anti-vibration plate, the ballast layer may be changed several times. In order to provide a strong and resistant surface of the anti-vibration plate to increase its ability to withstand changes of ballast layer it is preferred that the anti-vibration plate is covered on the first of its major side surfaces with a layer of surfactant-free geotextile.

In cases where the vibration damping system is used in the damping of vibrations e.g. from tramcars, subways and the like, the ballast layer is in principle substituted by a concrete layer, on top of which the rails are mounted. The vibration damping system is placed underneath the concrete layer. In between the concrete layer and the vibration damping system a thin layer of plastic material, geotextile or the like may be provided.

The geotextile may in principle be any type of geotextile provided that it is surfactant-free. By the term "geotextile" is meant any flexible plane structure of fibres.

By the term "surfactant-free" is meant that the fibres of the geotextile have not been treated with a surfactant, which in this application means a wetting agent or a tenside (surface tension decreasing agent).

The surfactant-free geotextile should preferably have a thickness of at least 0.1 mm, more preferably between 0.4 and 3 mm measured according to EN 964-1 under a load of 2 $kN/m^2$. A thickness between 0.5 and 1 mm will in most applications be optimal.

The surfactant-free geotextile may preferably be selected from the group consisting of staple fibre, continuous non-woven filament, thread-structure mats and strip mats. In a preferred embodiment the surfactant-free geotextile is a non-woven textile. These types of mats and their preparation are generally known to a skilled person. It has been found that a non-woven surfactant-free geotextile in general provides the anti-vibration plate with an optimal surface protection. The surfactant-free geotextile may e.g. be substantially watertight or alternatively it may be permeable for water.

The surfactant-free geotextile could in principle be of any kind of material. However in order to obtain a stable and sufficiently strong geotextile, it is preferred that the surfactant-free geotextile is made from fibres, threads or filaments of synthetic fibre, more preferably of polymeric materials. The synthetic fibre material may e.g. be selected from the group consisting of polyester, polyamide, polypropylene, polyether, polyethylene, polyetheramide, polyacrylnitrile, glass or a combination thereof. In a preferred embodiment the surfactant-free geotextile is made from fibres or filaments comprising or consisting of polyamide coated polyester and/or polypropylene.

The surfactant-free geotextile may preferably be fixed to the anti-vibration plate e.g. by heat fusing or gluing.

In order to protect the anti-vibration plate to an optimal degree, the surfactant-free geotextile should preferably have a tensile strength of at least 8 kN/m, preferably at least 20 kN/m measured according to EN ISO 10319. Preferably the surfactant-free geotextile should have a tensile strength in all directions of its plane which is above 8 kN/m.

Useful structures of geotextile are e.g. the geotextile marketed under the trade name "Typar® SF" by DuPont® Nonwovens.

In the vibration damping system according to the invention the anti-vibration plate may be more or less covered by the surfactant-free geotextile along one or more of the two major surfaces. The anti-vibration plate may e.g. be totally coated by the surfactant-free geotextile or it may be coated on its first major surface. In most embodiments it is not necessary to cover more than the first major surface of the anti-vibration plate and since the surfactant-free geotextile is relatively expensive, it is normally avoided to cover more than the first major surface of the anti-vibration plate. Depending on the ground surface condition it may be necessary to cover the second major surface also.

The vibration damping system may preferably further comprise a layer of a drain-core material comprising a three-dimensional matting of looped filaments.

The looped filaments should preferably have a sufficiently high strength to avoid a complete and permanent collapse under the load of the gravel, stones or similar covering materials which may be covered onto the vibration damping system. It is preferred that the looped filaments are made of polymeric monofilaments welded together where they cross, whereby an open structure with an open volume is provided. The looped filaments of the drain-core layer are preferably made from a material selected from the group consisting of polyamide, polyester, high-density polyethylene, polystyrene and combinations thereof. A particularly preferred material for the production of the looped filaments of the drain-core layer is polyamide.

The open volume should preferably constitute 80% or more of the total volume of the drain-core layer. The drain-core layer should preferably be placed between the first major surface of the anti-vibration plate and the covering layer of surfactant-free geotextile.

In a preferred embodiment of the vibration damping system according to the invention the vibration damping system further comprises a second layer of geotextile placed between the first major surface of the anti-vibration plate and the drain-core layer. This preferred embodiment, thus, includes a layered product comprising an mineral fibre board covered on its first major surface with a draining mat of a drain-core layer sandwiched between two layers of surfactant-free geotextile.

The thickness of the drain-core layer may preferably be up to about 15 mm. Drain-core layers thicker than that tend to be too soft for the requirement of static and dynamic stiffness of the system. Since the price of the drain-core layer is highly dependent on the height of this drain-core layer, it is preferred to use a height as low as possible of this layer, where the effect is optimal or at least satisfactory. It is preferred that the total thickness of the drain-core layer including the looped polyamide filaments, the surfactant-free geotextile and the second surfactant-free geotextile is at least 3 mm, preferably at least 5 mm. In general it is preferred that the surfactant-free geotextile is as thin as possible while still being able to provide a distribution of the forces against the underlying mineral fiber board. The geotextiles of the draining mat may preferably be glued or heat melted to the drain-core layer.

The second surfactant-free geotextile may be selected from the same group of materials and be of the same type as the surfactant-free geotextile as described above. The strength of the second surfactant-free geotextile is not so important, and, thus, the second surfactant-free geotextile may be of the same thickness as the surfactant-free geotextile or it may be thinner.

In a particularly preferred embodiment the draining mat is formed from two layers of surfactant-free geotextile of non-woven polyamide coated polyester fibres and a looped polyamide filament drain-core layer sandwiched between the two surfactant-free geotextile.

Useful draining mats of the above type are e.g. described in DE publication Nos. DE 2150590 and DE 4431976. A particularly preferred type of draining mats is marketed by Colbond Geosynthetics, The Netherlands, under the trade name Enkadrain®.

One or more of the surfaces which are not covered with geotextile may preferably be covered with a surface coating in the form of a fibrous netting formed of a thermoplastic polymer material. Particularly, it is preferred that one or more side surfaces of the anti-vibration plate are covered with such a surface coating in the form of a fibrous netting. Such covering material is further described in EP 629153.

The invention also relates to a method of preparing an anti-vibration plate according to the invention comprising the steps of preparing a plate comprising mineral fibres, a polymeric material and/or a polymeric foam as defined above and subjecting an area of the opposite surfaces of the plate to a compression treatment in one or more steps, which compression treatment is sufficient to reduce the static and/or dynamic stiffness of the plate by at least 10%, preferably at least 15%, more preferably at least 20% compared to the static and/or dynamic stiffness prior to the compression treatment.

In a preferred embodiment the compression treatment comprises the step of subjecting an area of the opposite surfaces of the plate at the compression pressure in the interval from 50 to 250 kN/m$^2$, preferably from 80 to 200 and more preferably from 100 to 150 kN/m$^2$ whereby the static stiffness of the plate measured according to the method defined in Deutsche Bahn-Norm BN 918 071-1 (September 2000) is reduced.

As mentioned above it is in general insignificant which method has been used for subjecting the opposite surfaces of the plate to the compression treatment, but it is preferred that the method comprises the step of subjecting the plate to a compression treatment by rolling through one or more pairs of rollers. The rollers should preferably have a relatively high diameter, e.g. a diameter of at least 100 mm in order to make an equal pressure over the whole area of the material.

The invention also relates to a method of applying a vibration damping system to a ground subjected to vibrations.

The method comprises the steps of:

i providing an anti-vibration plate, preferably using the method as defined above;

ii optionally covering one or more surfaces of the anti-vibration plate as defined above;

iii applying the anti-vibration plate onto the ground with its first major surface upwardly;

iv covering the first major surface of the anti-vibration plate with concrete, stone, gravel, soil and/or asphalt.

Prior to the application of the vibration damping system the ground may preferably be prepared e.g. by leveling the ground in the depression in the ground, where the vibration damping system is to be applied. Furthermore, the ground may preferably be further stabilised e.g. by covering the ground with a material selected from the group consisting of water pervious foil, granulates of rubber, gravel or mixtures thereof.

If the major surface of the anti-vibration plate is covered with a covering layer in the form of a surfactant-free geotextile and/or drain-core layer or a draining mat, it is preferred that the surfactant-free geotextile and the anti-vibration plate are glued, sewed or heat fused together. This may be done on ground or in factory.

Alternatively, the anti-vibration plate may first be applied to the ground and thereafter a covering layer in the form of a surfactant-free geotextile and/or drain-core layer or a draining mat is applied onto the first major side of the anti-vibration plate.

If the vibration damping system further comprises a drain-core layer and/or a second layer of surfactant-free geotextile, these layers may be applied one by one onto the anti-vibration plate prior to the application of the surfactant-free geotextile, or these layers may be applied together with the surfactant-free geotextile in the form of a draining mat as defined above.

The draining mat may preferably be applied from a roll of draining mat material directly onto the anti-vibration plate or plates. It is preferred that the draining mat material from one roll covers two or more anti-vibrations plates. The width of the roll of draining mat material should preferably be at least substantially equal to the width of the anti-vibration plates.

When the vibration damping system has been safely applied, the first surface of the anti-vibration plate or optionally the covered first surface of the anti-vibration plate board may further be covered with concrete, stone, gravel, soil and/or asphalt or similar materials. Finally, a railway track may be applied onto the vibration damping system.

The vibration damping system according to the invention is preferably used for damping the vibrations caused by trains, trolley busses, tramcars and/or other traffic on a railway or roadway, wherein the use comprises incorporation of the vibration damping system in the ground under the railway and/or road.

EXAMPLE

An anti-vibration plate according to the invention having a first and a second major surface was provided as described in the following. The anti-vibration plate was made from rock wool and had a density of about 220 kg/m$^3$. The dimension of the anti-vibration plate was about 35 mm×600 mm×100 mm. The anti-vibration plate was obtained by a method comprising the step of subjecting an area of the plate to a compression treatment. The compression treatment was made through rollers having a diameter of about 20cm. The compression treatment reduced the static stiffness of the plate by about 40% compared to the static stiffness prior to the compression. The static stiffness before the compression treatment was 0.023 N/mm$^3$ and after the compression treatment it was 0.014 N/mm$^3$, measured according to the method defined in BN 918 071-1.

The invention claimed is:

1. A method of preparing an anti-vibration plate for a vibration damping system, said method comprising the steps of:

preparing a plate comprising mineral fibres, a polymeric material having a Shore A hardness of between 35-98 and/or a polymeric foam having a density of 20-240 kg/m$^3$; and subjecting an area of the opposite surfaces of the plate to a compression treatment in one or more steps, which compression treatment is sufficient to reduce the static and/or dynamic stiffness of the plate by at least 10%, compared to the static and/or dynamic stiffness prior to the compression treatment.

2. A method according to claim 1, wherein the polymeric material has an E-modulus varying between $2\times10^5$ and $69\times10^8$ Pa.

3. A method according to claim 1, wherein the polymeric foam has an E-modulus varying between $2\times10^5$ and $69\times10^8$ Pa.

4. A method of preparing an anti-vibration plate for a vibration damping system, said method comprising the steps of:

preparing a plate comprising mineral fibres and one or more hollow spaces; and subjecting an area of the opposite surfaces of the plate to a compression treatment in one or more steps, which compression treatment is sufficient to reduce the static and/or dynamic stiffness of the plate by at least 10% compared to the static and/or dynamic stiffness prior to the compression treatment.

5. A method according to claim 1 or 4, wherein the anti-vibration plate is obtainable by a method comprising the step of subjecting the plate to a compression treatment, wherein said compression treatment comprises the step of subjecting an area of the opposite surfaces of the plate to a compression pressure in the interval from 50 to 250 kN/m$^2$, whereby the static and/or dynamic stiffness of the plate measured according to the method defined in Deutsche Balm-Norm BN 918 071-1 is reduced.

6. A method according to claim 1 or 4, wherein the anti-vibration plate is obtainable by a method comprising the step of subjecting the plate to a compression treatment by rolling through one or more pairs of rollers.

7. A method according to claim 1, wherein the anti-vibration plate is in the form of a layer of mineral fibres having a density above 200 kg/m$^3$.

8. A method according to claim 1, wherein the anti-vibration plate is in the form of a layer of polymeric material having a density of 400-1300 kg/m$^3$.

9. A method according to claim 8, wherein the layer of polymeric material comprises natural or synthetic rubbers or mixtures of natural and synthetic rubbers, the layer of polymeric material preferably being made from a material selected from the group consisting of butadiene rubber, butyl rubber, isoprene rubber, styrene-butadiene rubber, natural rubber, polyacrylate rubber, ethylene-acrylate rubber, ethylene-propylene rubber, nitrile rubber and mixtures thereof.

10. A method according to claim 1, wherein the anti-vibration plate is in the form of mineral fibres and wherein at least 75%, by number of the fibres are placed in a direction substantially parallel +/−25° with the plane of the plate, where the direction of a fibre is determined as the direction of the line representing the longest distance from one point on the fibre to another point on the fibre.

11. A method according to claim 1, wherein the anti-vibration plate is in the form of mineral fibres and wherein the major part of the fibres in the vertical direction +/−20° are broken after the plate has been subjected to the compression treatment.

12. A method according to claim 1, wherein the anti-vibration plate is covered on the first of its major side surfaces with a layer of surfactant-free geotextile.

13. A method according to claim 12, wherein the vibration damping system further comprises a layer of a drain-core material comprising a three-dimensional matting of looped filaments, whereby an open structure is provided, wherein the open volume constitutes 80% or more of the total volume of the drain-core layer.

14. A method according to claim 13, wherein the vibration damping system further comprises a second layer of geotextile.

15. A method according to claim 1, wherein the anti-vibration plate is covered on one or more of its side surfaces with a surface coating in the form of a fibrous netting formed of a thermoplastic polymer material.

16. A method of applying a vibration damping system to a ground which is subjected to vibrations, said method comprising the steps of providing an anti-vibration plate, using the method according to claim 1 or 4;

applying the anti-vibration plate onto the ground with its first major surface upwardly; and covering the first major surface of the anti-vibration plate with concrete, stone, gravel, soil and/or asphalt.

17. A method of applying a vibration damping system according to claim 16, wherein the major surface of the anti-vibration plate is covered with a covering layer in the form of a surfactant-free geotextile and/or drain-core layer or a draining mat, prior to the application onto the ground.

18. A method of applying a vibration damping system according to claim 16, wherein the anti-vibration plate is first applied to the ground, and thereafter a covering layer in the form of a surf actant-free geotextile and/or drain-core layer or a draining mat, is applied onto the first major side of the mineral fibre board.

19. A method of applying a vibration damping system according to claim 16, wherein the first surface of the anti-vibration plate or the optionally covered first surface of the anti-vibration plate board is covered with concrete, stone, gravel, soil and/or asphalt, said method further comprising the step of applying a railway track onto the vibration damping system.

20. A method of damping the vibrations caused by traffic on a railway or roadway, which comprises incorporation of the vibration damping system obtained according to the method of claim 1 or 4 in the ground under the railway and/or road.

21. A method according to claim 1, wherein the polymeric material has an E-modulus varying between $2\times10^5$ and $69\times10^8$ Pa.

22. A method according to claim 1 or 4, wherein the compression treatment is sufficient to reduce the static and/or dynamic stiffness of the plate by at least 15% compared to the static and/or dynamic stiffness prior to the compression treatment.

23. A method according to claim 1 or 4, wherein the compression treatment is sufficient to reduce the static and/or dynamic stiffness of the plate by at least 20% compared to the static and/or dynamic stiffness prior to the compression treatment.

24. A method according to claim 5, wherein the compression pressure is in the interval from 80 to 200 kN/m$^2$.

25. A method according to claim 5, wherein the compression pressure is in the interval from $10^0$ to 150 kN/m$^2$.

26. A method according to claim 6, wherein the rollers have a diameter of at least 100 mm.

27. A method according to claim 8, wherein the polymeric material has a thickness of 5-70 mm.

28. A method according to claim 10, wherein at least 85% by number of the fibres are placed in a direction substantially parallel +/−25° with the plane of the plate.

29. A method according to claim 10, wherein at least 95% by number of the fibres are placed in a direction substantially parallel +/−25° with the plane of the plate.

30. A method according to claim 12, wherein the surfactant-free geotextile has a thickness of at least 0.1 mm measured according to EN 964-1 under a load of 2 kN/m$^2$.

31. A method according to claim 12, wherein the surfactant-free geotextile has a thickness between 0.4 and 3 mm measured according to EN 964-1 under a load of 2 kN/m$^2$.

32. A method according to claim 13, wherein the three-dimensional matting of looped filaments is made of polymeric monofilaments welded together where they cross.

33. A method according to claim 13, wherein said drain-core layer is disposed between said first major surface of said anti-vibration plate and said covering layer of surfactant-free geotextile.

34. A method according to claim 14, wherein the second layer of geotextile is disposed between said first major surface of said mineral fibre board and said drain-core layer to thereby provide a layered product comprising a mineral fibre board covered on its first major surface with a draining mat of a drain-core layer sandwiched between two layers of surfactant-free geotextile.

35. A method of applying a vibration damping system according to claim 17, wherein said covering layer and said anti-vibration plate are glued or heat fused to each other.

* * * * *